US005486908A

United States Patent [19]

Miyamoto et al.

[11] Patent Number: 5,486,908

[45] Date of Patent: Jan. 23, 1996

[54] FIXING UNIT HAVING HEATING ROLLER AND PRESSURE ROLLER

[75] Inventors: Takeshi Miyamoto; Kouji Okumura; Motohiro Suzaki, all of Gifu, Japan

[73] Assignee: Sanyo Electric Co., Ltd., Moriguchi, Japan

[21] Appl. No.: 248,478

[22] Filed: May 24, 1994

[30] Foreign Application Priority Data

May 24, 1993 [JP] Japan ..... 5-121021

[51] Int. Cl.[6] ..... G03G 15/20

[52] U.S. Cl. ..... 355/290; 355/282; 355/285

[58] Field of Search ..... 355/282, 285, 355/289, 290, 295; 219/216

[56] References Cited

U.S. PATENT DOCUMENTS

| | | | |
|---|---|---|---|
| Re. 33,770 | 12/1991 | Torino et al. | 355/290 |
| 4,163,892 | 8/1979 | Komatsu et al. | 219/216 |
| 5,124,755 | 6/1992 | Hediger | 355/285 |
| 5,177,552 | 1/1993 | Isogai et al. | 355/285 |
| 5,239,349 | 8/1993 | Hoover et al. | 355/282 |
| 5,287,156 | 2/1994 | Shikada et al. | 355/285 |
| 5,345,301 | 9/1994 | Satoh et al. | 355/290 |

*Primary Examiner*—Sandra L. Brase
*Attorney, Agent, or Firm*—Darby & Darby

[57] ABSTRACT

A fixing unit is included in a image forming apparatus, and includes a heating roller and a pressure roller. A separating layer is formed on a surface of the heating roller, and an elastic member layer is formed on a surface of the pressure roller, and both are brought into pressure-contact with each other in a state where the elastic member layer is in elastic deformation. The heating roller and the pressure roller are rotatably supported at fixed positions by bearings, respectively. At this time $L=D1/2+D2/2-B^2/4\ (1/D1+1/D2)$, where D1 is a diameter of the heating roller, D2 is a diameter of the pressure roller, B is nip width between the rollers, and L is a center distance between the rollers is satisfied.

12 Claims, 15 Drawing Sheets

10

80

FIXING UNIT HAVING HEATING ROLLER AND PRESSURE ROLLER

BACKGROUND OF THE INVENTION

1. Field of the Invention

The present invention relates to a fixing unit. More specifically, the present invention relates to a fixing unit which includes a heating roller and a pressure roller, and is utilized in an imaging forming apparatus such as an electrophotographic copying machine, a laser printer, an LED printer, and etc.

2. Description of the Prior Art

In such a kind of fixing unit, in many cases, the heating roller includes a core made of aluminum, and a separating layer which is formed on a surface of the core by coating fluororesin or the like and is for making a releasability of a toner good, and the pressure roller includes a core made of iron and an elastic member layer formed on a surface of the core with silicon rubber. In some prior arts, an elastic member layer is also formed on the surface of the core of the heating roller, and the separating layer is also formed on the elastic member layer.

In a prior art fixing unit 1 shown in FIG. 16, a heating roller 2 and a pressure roller 3 are rotatably supported by bearings 4 and 5, respectively. At least one of each of bearings 4 and 5 is arranged at both ends of each of the heating roller 2 and the pressure roller 3. Then, the pressure roller 3 is brought into pressure-contact with the heating roller 2 by a coil spring 6. The coil spring 6 is arranged between the bearing 5 supporting the pressure roller 3 and a main unit frame (not shown), and applies a proper pressure-contact force between the heating roller 2 and the pressure roller 3.

In the prior art shown in FIG. 16, since the coil spring 6 is utilized, it is difficult to assemble the fixing unit, and thus, an image forming apparatus. Furthermore, in this prior art, since the pressure-contact force between the heating roller 2 and the pressure roller 3 and a nip width between the both rollers are always constant irrespective of a thickness of a recording paper, a cockle or curling occurs in a thin recording paper while a fall of a fixing strength occurs in a thick recording paper having a relatively rough surface.

Therefore, in another prior art, a specific control unit for variably setting a fixing temperature in accordance with a king (size or thickness) of the recording paper is utilized. In this prior art, the fixing temperature is lowered in a case of a thin recording paper and the fixing temperature is raised in a case of a thick recording paper, and therefore, it is possible to solve the above described problem. However, in this prior art, the specific control unit becomes to be required, and therefore, a cost of an image forming apparatus becomes high.

SUMMARY OF THE INVENTION

Therefore, a principal object of the present invention is to provide a fixing unit capable of excellently fixing a toner image onto a recording paper with simple structure.

A fixing unit according to the present invention comprises: a pair of a heating roller and a pressure roller having an elastic member formed on a surface of at least one of both and being brought into pressure-contact with each other in a state where the elastic member is elastically deformed; and supporting means for rotatably supporting the heating roller and the pressure roller at fixed positions, respectively such that a relationship between a diameter D1 of the heating roller, a diameter D2 is the pressure roller, a nip width b between the both rollers and a center distance L between the both rollers satisfies the following equation.

$$L=D½+D2/2-B^2/4\ (1/D1+1/D2)$$

At first, through experiment, for example, a nip width B with which a toner image can be excellently fixed onto a recording sheet irrespective of a thickness of the recording sheet is determined. Then, the center distance L is determined according to the above described equation on the basis of the nip width B, the diameter D1 of the heating roller and the diameter D2 of the pressure roller. The heating roller and the pressure roller are supported at the fixed positions by the supporting means such as a bearing so as to keep the center distance L.

In a case where the recording sheet is thin, since a deformation amount of the elastic member is small, the heat and pressure are applied to the toner image and the recording sheet with a relatively narrow nip width, that is, for a relatively short fixing time. Therefore, no cockle or curling occurs in the recording sheet. At this time, because the recording sheet is thin, it is possible to obtain a sufficient fixing length even if the nip width is narrow, that is, even if the fixing time is short.

On the other hand, in a case where the recording paper is thick, since the deformation amount of the elastic member is large, the heat and pressure are applied to the toner image and the recording sheet with a relatively wide nip width, that is, for a relatively long fixing time. Therefore, it is possible to obtain a suitable fixing strength. At this time, no cockle or curling occurs in the thick recording sheet even if the recording sheet is sandwiched with a wide nip width because the thick recording sheet is firm.

In accordance with the present invention, it is possible to obtain a fixing unit in which no cockle or curling occurs and a sufficient fixing strength is obtained irrespective of a thickness of a recording sheet, with no coil spring or specific control unit of the prior arts.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
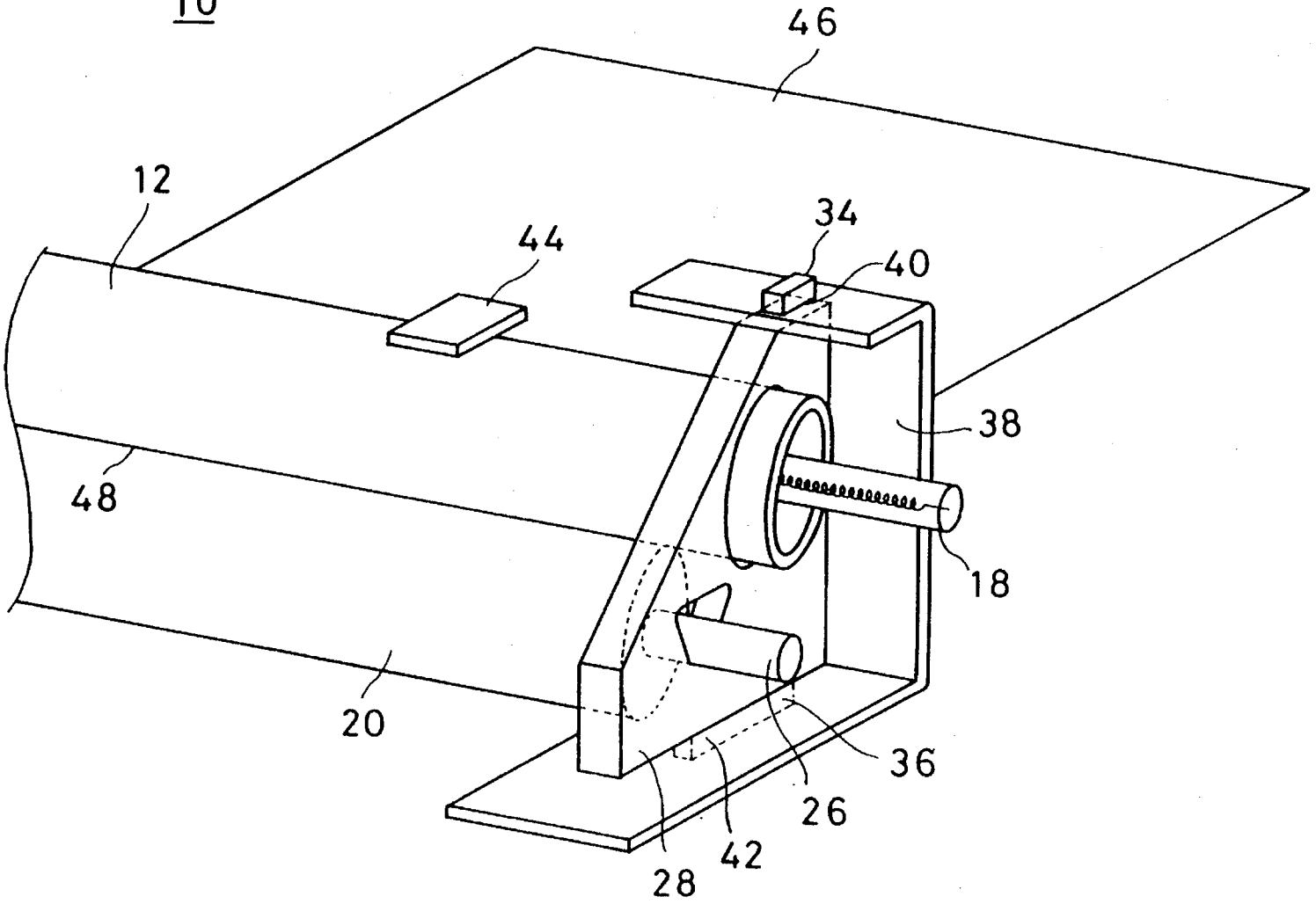
FIG. 1 is a perspective view showing a major portion of one embodiment according to the present invention.
Figure 4:
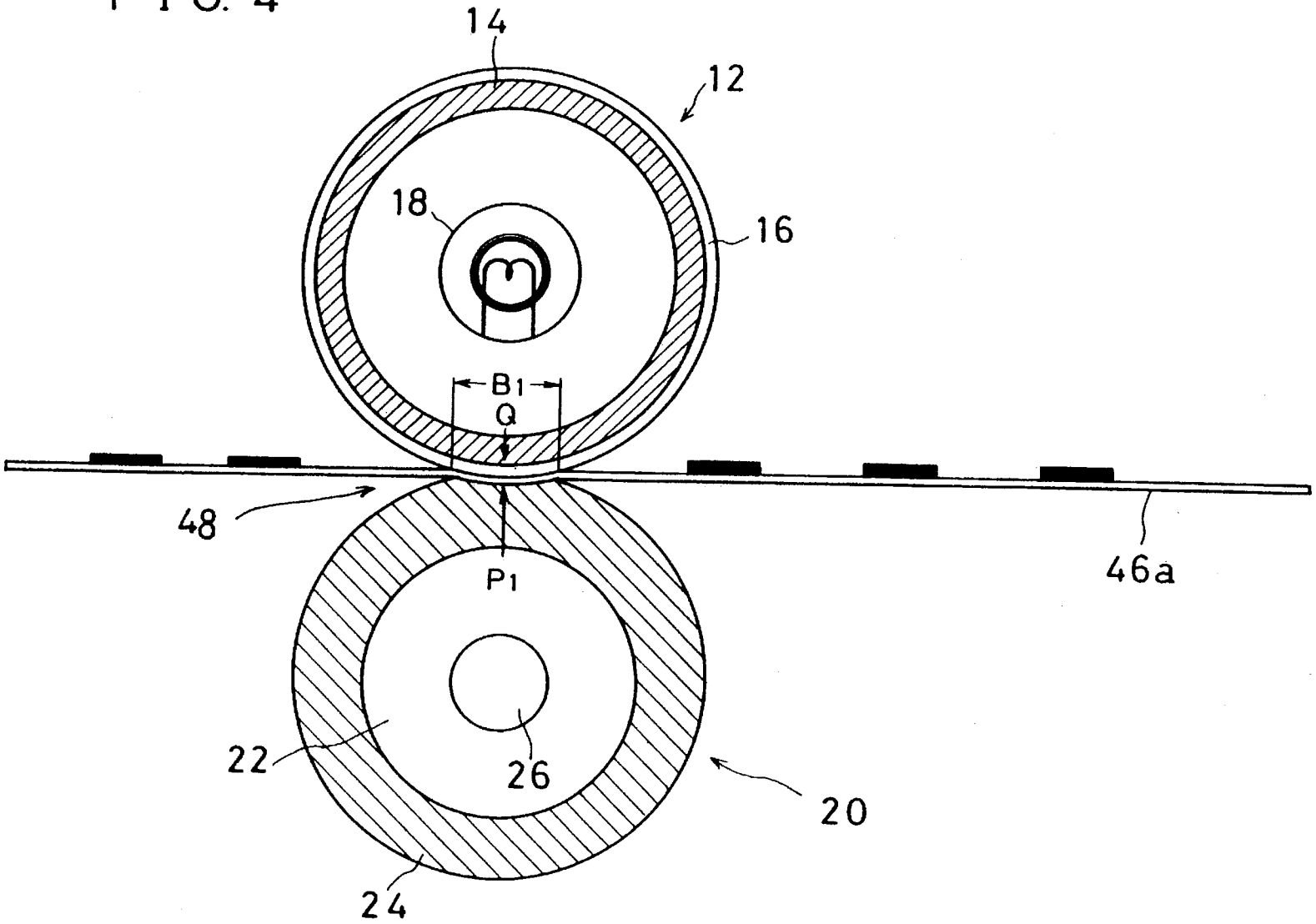
FIG. 4 is an illustrative view showing a state of a nip portion when a toner image is fixed onto a thin recording sheet.

With referring to FIG. 1, a fixing unit 10 of this embodiment shown includes a heating roller 12. As shown in FIG. 4, the heating roller 12 includes a core having a form of a hollow cylinder made of aluminum and etc. A separating layer 16 is formed on a surface of the core 14. The separating layer 16 is for releasability of a melt toner good, and formed by coating of fluororesin and etc. A heater 18 for heating the heating roller 12 is arranged in the hollow portion of the core 14.

A pressure roller 20 is brought into pressure-contact with the heating roller 12. The pressure roller 20 includes a core having a form of a hollow cylinder made of iron and etc. An elastic member layer 24 made of silicon rubber or the like is formed on a surface of the core 22 with a thickness of 3–8 mm. In addition, 5 mm is especially suitable for the thickness of the elastic member layer 24 because a cost becomes high when the thickness of the elastic member layer 24 is larger than 5 mm and no correction effect of a nip width is obtained when the thickness of the elastic member layer 24 is smaller than 5 mm. A shaft 26is inserted or fixed to the core 22. In addition, an elastic member such as silicon rubber becomes to have long life and lower creep because of a technical innovation, and therefore, a shrinkage amount of the elastic member is kept at a degree of 10–20 μm even if the elastic member is used for a long time. Therefore, without use of spring or the like, it is possible to keep a state of a nip portion 48 (described later) in a desired state for a long period. In noting such a point, in the present invention, the center distance between the heating roller and the pressure roller is fixed so as to set the nip portion 48 in the desired state, whereby the disadvantage of the prior art can be eliminated.

Both ends of the heating roller 12 and both ends of the shaft 28 of the pressure roller 20 are rotatably supported at fixed positions, respectively, by a bearing 28 which is utilized for the both of the heating roller 12 and the pressure roller 20. At this time, the heating roller 12 and the pressure roller 20 are brought into pressure-contact with each other in a state where the elastic member layer 24 is elastically deformed, and made rotation free.

Figure 2:
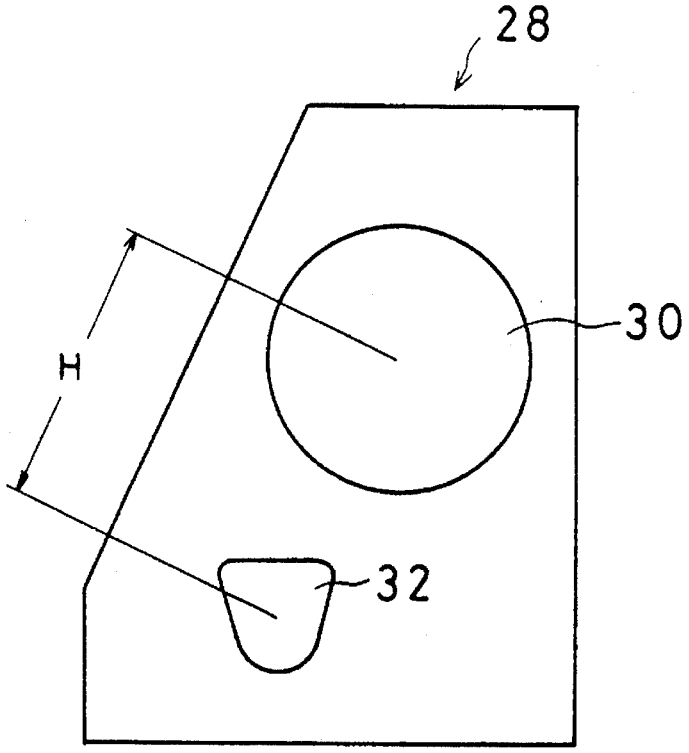
FIG. 2 is a front view showing one example of a bearing of FIG. 1 embodiment.

The bearing 28 is formed as a pentagon bearing plate, for example, as shown in FIG. 2. A hole 30 for supporting the heating roller and a hole 32 for supporting the pressure roller shaft are formed on the bearing 28 by punching the same. A center distance H between the holes 30 and 32 is set such that an optimum nip width can be obtained. More specifically, the center distance H is determined on the basis of the nip width B with which no cockle or curling occurs and a suitable fixing strength can be obtained when the toner image is fixed onto the recording sheet by the heating roller 12 and the pressure roller 20.

In addition, in view of a friction between the heating roller 12 and the pressure roller shaft 26, and the bearing 28, the bearing 28 is made of resin having heat resistance and slidability such as resin in which PPS (Polyphenylenesulfide) and PTFE (Polytetrafluoroethylene) are mixed, or resin in which PI (Polyimide) and PTFE are mixed. However, it can be considered that the bearing 28 is made of heat resistant resin, and only inner peripheries of the holes 30 and 32 are coated with resin having the slidability, for example, fluororesin.

Then, an optimum nip width B is determined in accordance with a recording sheet feeding speed (process speed), and a relationship of the both is indicated in the following table 1.

TABLE I

| feeding speed (sheet/minute) | >40 | 30–40 | 20–30 | <20 |
|---|---|---|---|---|
| nip width | 6 | 5 | 4.5 | 3 |

Figure 3:
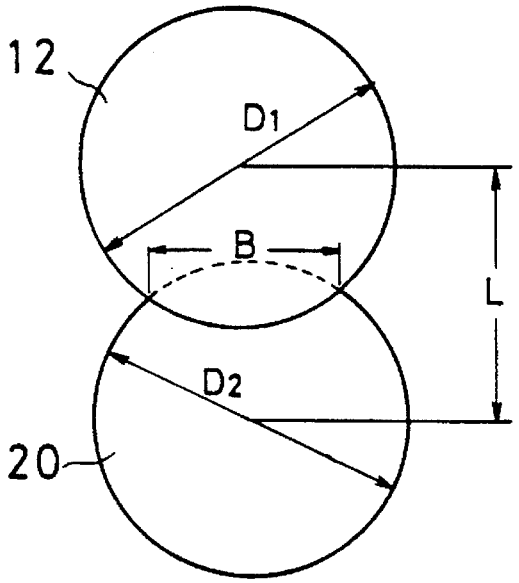
FIG. 3 is an illustrative view showing a relationship between a diameter of a heating roller, a diameter of a pressure roller, a nip width between the both rollers, and a center distance between the both rollers.

In accordance with the nip width, the center distance L is determined. That is, a relationship of the diameter D1 of the heating roller, the diameter D2 of the pressure roller 20, and the nip width B, and the center distance L is determined according to the following equation with referring to FIG. 3.

$$L=D1/2+D2/2-B^2/4\ (1/D1+1/D2)$$

For example, when D1=25 mm, D2=30 mm and B=3 mm, the center distance L becomes approximately 27.3 mm. On the basis of the center distance L, the center distance H between the holes 30 and 32 is determined.

Returning to FIG. 1, projections 34 and 36 are formed in an upper portion and a lower portion of the bearing 28, respectively. By engaging the projections 34 and 36 to holes 40 and 42 formed on a main unit frame 38 having approximately L-letter shape, the bearing 28 is fixed to the main unit frame 38. In addition, above the heating roller 12, a thermistor 44 for controlling a surface temperature of the heating roller 12 is arranged.

Then, not shown but well-known, a toner image formed through respective processes of charging, exposure and development is transferred onto a recording sheet 46 such as a paper. The recording sheet 46 on which the toner image has been transferred is fed to the nip portion 48 which is formed by a pressure-contact portion of the heating roller 12 and the pressure roller 20. Then, by receiving the heat and pressure at the nip portion 48, the toner image is fixed onto the recording sheet 46, and the recording sheet 46 is then discharged through a discharging path (not shown).

When a relatively thin recording sheet 46*a* on which the toner image has been transferred is sent to a portion between the heating roller 12 and the pressure roller 20 as shown in FIG. 4. The recording sheet 46*a* receives a heat quantity Q from the heating roller 12 and a pressure force P1 by the pressure-contact during the same is passing through the nip portion 48 having a nip width B1, whereby the toner image is fixed onto the recording sheet 46*a*. At that time, even if the recording sheet 46*a* is thin, it is possible to obtain a sufficient fixing strength but no cockle or curling occurs in the recording sheet 46*a* because a time that the recording sheet 46*a* receives the heat and pressure at the nip portion 48 is short.

Figure 5:
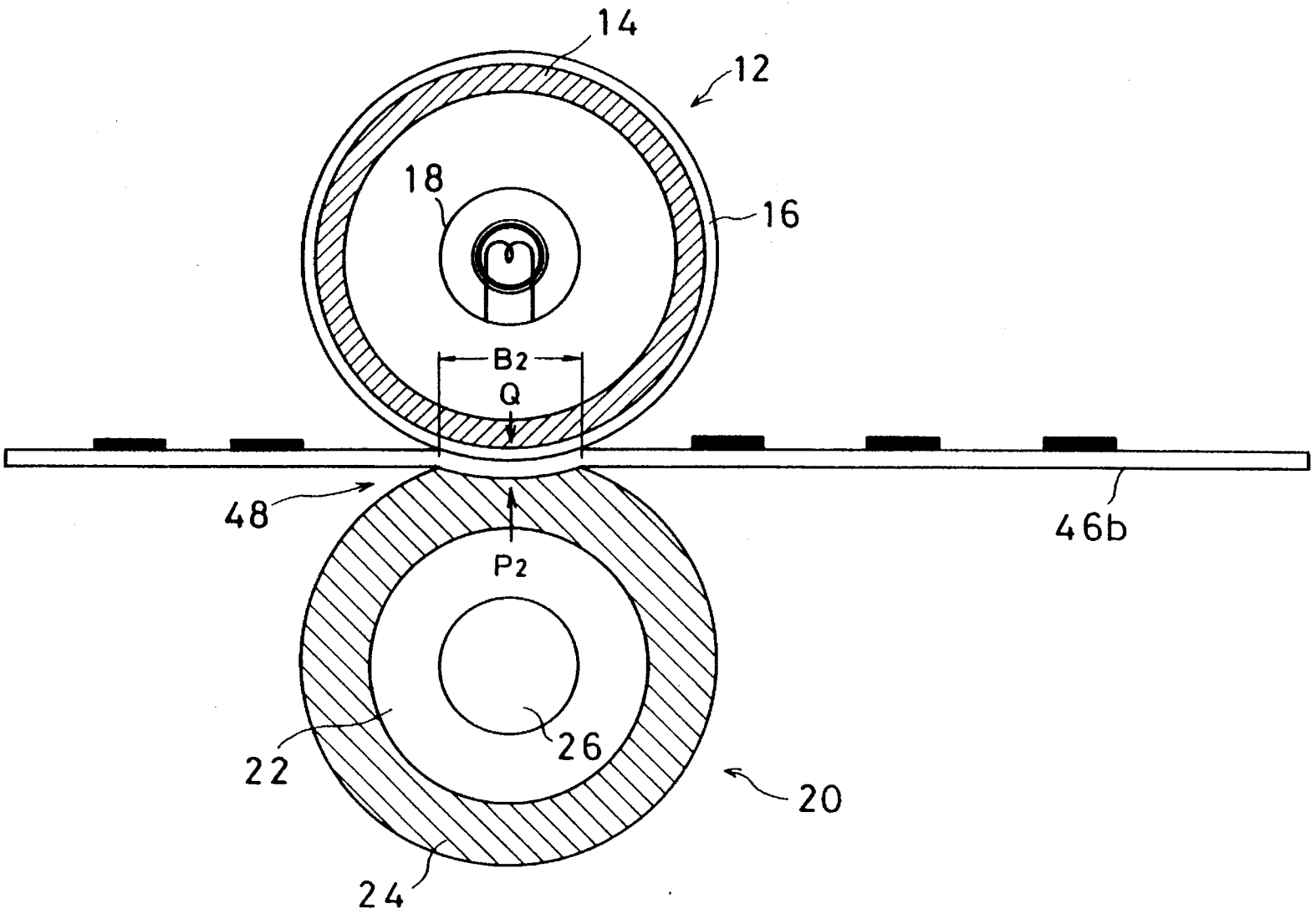
FIG. 5 is an illustrative view showing a state of the nip portion when a toner image is fixed onto a thick recording sheet.

As shown in FIG. 5, if a relatively thick recording sheet 46*b* on which the toner image has been transferred is fed between the heating roller 12 and the pressure roller 20, a nip width B2 is automatically widened in comparison with the nip portion B1 (FIG. 4) due to a thickness of the recording sheet 48*b* and therefore, a pressure force P2 becomes higher than pressure force P1. Accordingly, during the recording sheet 46*a* is passing through the nip portion 48 having the nip width B2, the recording sheet 46 receives the heat and pressure for a time long than the time of a case of the recording sheet 46*a* (FIG. 4) such that the toner image is fixed onto the recording sheet 46*b*. Resultingly, even if the relatively thick recording sheet 46*b* having a rough surface is utilized; it is possible to obtain a sufficient fixing strength. Furthermore, since the relatively thick recording sheet 46*b* is firm in comparison with the relatively thin recording sheet 46*a*, no cockle or curling occurs in the recording sheet 46*b* even if the same receives the heat and pressure for a long time.

Thus, according to the FIG. 1 embodiment, it is possible to obtain a sufficient fixing strength with no cockle or curling irrespective of the thickness of the recording sheet 46.

Furthermore, in FIG. 1 embodiment, the bearing 28 is attached to the main unit frame 38 by engaging the projections 34 and 36 of the bearing 28 to the holes 40 and 42 of the frame 38, and therefore, it is unnecessary to separately prepare a fastening member such as a screw for attaching the bearing 28 to the frame 38, and accordingly, it is possible to shorten a time for assembling and adjusting a fixing unit, and thus, an image forming apparatus, and it is possible to shorten a working time for maintenance of the image forming apparatus.

Figure 6:
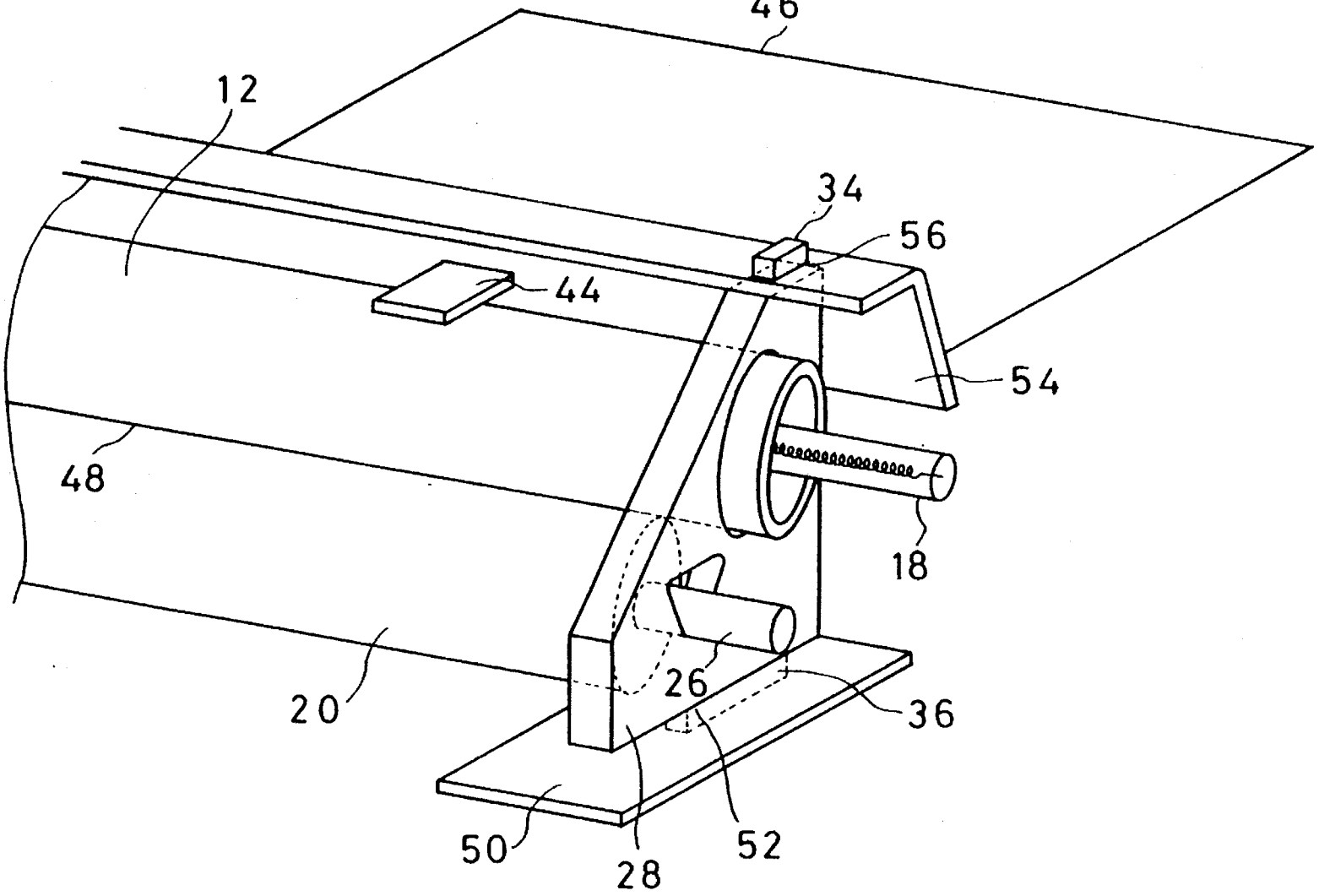
FIG. 6 is a perspective view showing a major portion of another embodiment according to the present invention.

Furthermore, in order to fix the bearing 28 to a plate-like main unit frame 50, as shown in FIG. 6, the projection 36 may be engaged or inserted to a hole 52 which is formed on the main unit frame 50, and the projection 34 may be inserted or engaged to a hole 56 which is formed on a cover 54 having approximately V-letter shape in cross-section. The cover 54 is made of metal or heat resistant resin such as an engineering plastic, and is for projecting peripheral components within the main unit and a user of the image forming apparatus from the heating roller 12 being at a high temperature.

Figure 7:
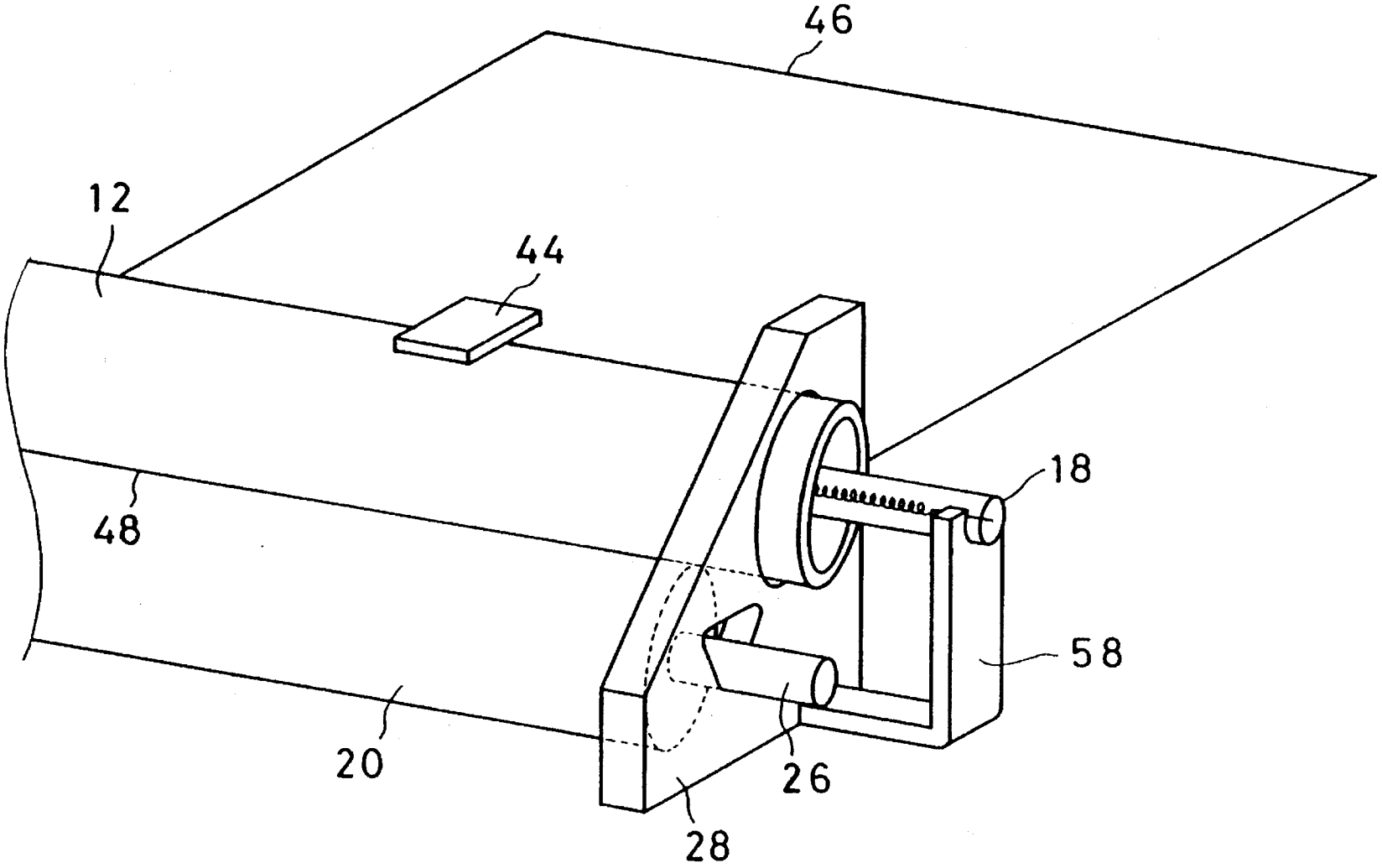
FIG. 7 is a perspective view showing a major portion of another embodiment according to the present invention.

Furthermore, as shown in FIG. 7, the bearing 28 may be formed uniformly with an approximately L-letter shape holder 58 for supporting both ends of the heater 18.

In addition, in the above described embodiments, as the bearing 28, a sheet of bearing plate is utilized, by which the both of the heating roller 12 and the pressure roller 20 are supported; however, it is needless to say that bearings for the heating roller 12 and the pressure roller 20 are separately prepared and the heating roller 12 and the pressure roller 20 are supported by the bearings, respectively, such that the center distance L can be fixed or kept.

Figure 8A:
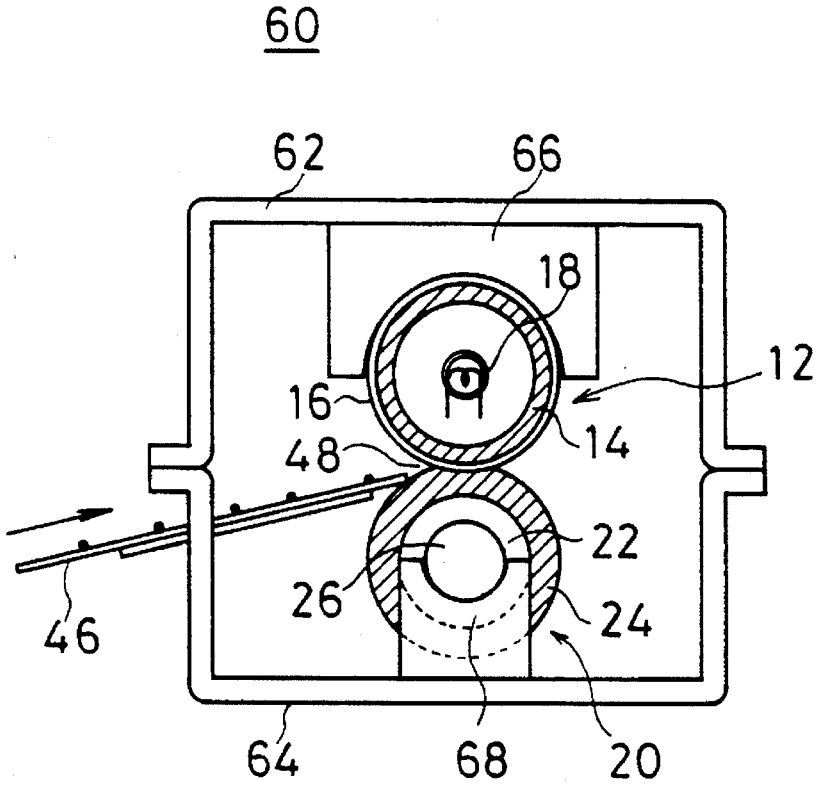
FIG. 8(A) is a front view showing a major portion of another embodiment according to the present invention.
Figure 8B:
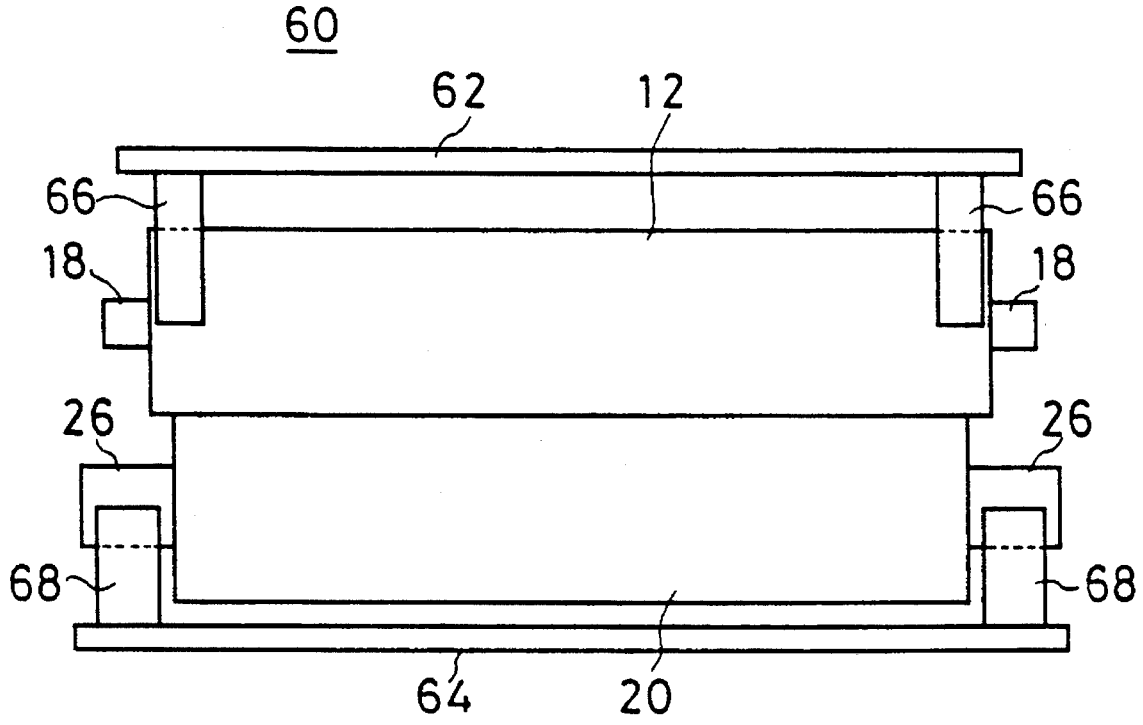
FIG. 8(B) is a side view thereof.

Next, a fixing unit 60 of another embodiment according to the present invention, shown in FIG. 8, includes the heating roller 12 and the pressure roller 20 as similar to FIG. 1 fixing unit 10.

In the fixing unit 60, the circumferences of the heating roller 12 and the pressure roller 20 are covered by an upper cover 62 and a lower cover 64 each having heat resistance for heat-insulating between peripheral components and the high temperature heating roller 12 and the pressure roller 20 and for protecting the user from the high temperature. Each of the upper cover 62 and the lower cover 64 may be made of metal or resin.

In this embodiment shown, the upper cover 62 and the lower cover 64 are, as similar to the above described cover 54, made of heat resistant resin such as an engineering plastic. At a present time, such the heat resistant resin can not be deformed even if the heat of 200° C. or more is applied thereto. On the other hand, bearings 66 and 68 which support the heating roller 12 and the pressure roller 20 at the respective fixed positions and bring the both into pressure-contact with each other are made of resin having heat resistance and slidability such as resin in which PPS and PTFE are mixed or resin in which PI and PTFE are mixed and the heat resistantive temperature of the bearings 66 and 68 is 200° C. or more that is equal to the heat resistantive temperature of the upper cover 62 and the lower cover 64.

In FIG. 8 embodiment, in noting a point that the heat resistantive temperatures of the upper cover 62, the lower cover 64, and the bearings 66 and 68 are approximately equal to each other, the cover and the bearing are uniformly molded or formed, whereby the center distance L between the heating roller 12 and the pressure roller 20 can be fixed or kept, and thus,the nip portion is set in the desired state. In addition, two bearings 66 which are uniformly molded with the upper cover 62 and two bearings 68 which are uniformly molded with the lower cover 64 support both end portions of the heating roller 12 and both end portions of the pressure roller shaft 26, respectively.

In assembling the fixing unit 60 of FIG. 8 embodiment, by joining or coupling the upper cover 62 and the lower cover 64 to each other in a state where the heating roller 12 and the pressure roller 20 are sandwiched by the upper cover 62 and the lower cover 64, the heating roller 12 and the pressure roller 20 are rotatably supported by the bearings 66 and 68 and brought into pressure-contact with each other in a state where the elastic member layer 24 is elastically deformed.

Figure 9:
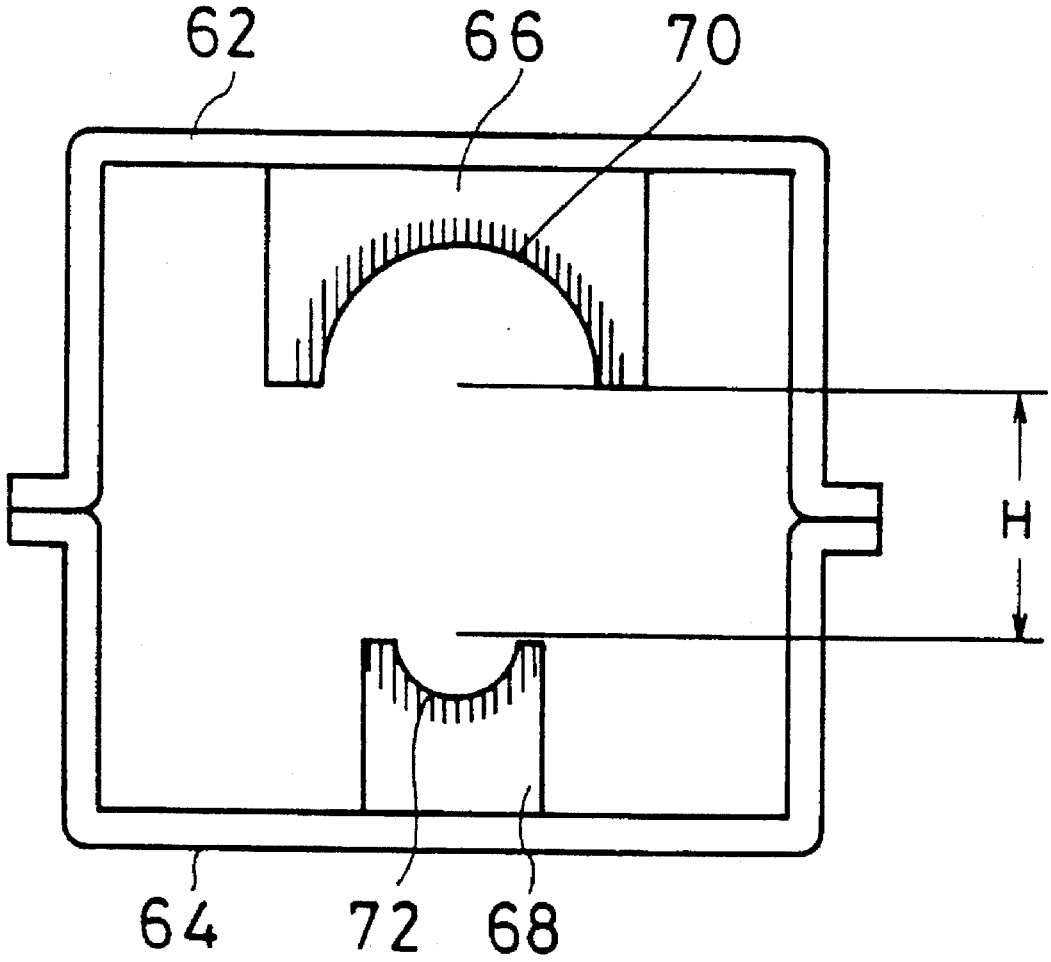
FIG. 9 is a front view showing one example of a bearing which is uniformly formed with a cover.

As shown in FIG. 9, a semicircle bearing portion 70, (hatched portion) which is brought into contact with the heating roller 12 and allows the heating roller 12 to be slidden is formed on the bearing 66, and a semicircle bearing surface 72 (hatched portion) which is brought into contact with the pressure roller 20 and allows the pressure roller 20 to be slidden is formed on the bearing 68.

Since the heating roller 12 and pressure roller 20 are brought into contact with the bearing surfaces 70 and 72 with being rotated, respectively, it is required that the bearing surfaces 70 and 72 have not only the heat resistance but also the slidability. Therefore, in this embodiment shown, the bearings 66 and 68 are uniformly molded or formed with the upper cover 62 and the lower cover 64, respectively, by utilizing the above described resin having the heat resistance and the slidability. In addition, since no slidability is needed at a portion except the bearing surfaces 70 and 72, it can be considered that the bearings 66 and 68 are uniformly molded with the upper cover 62 and the lower cover 64, respectively, by utilizing the heat resistant resin such as PPS, and a material having the slidability such as fluorine may be formed on only portions of the bearing surfaces 70 and 72 by coating or evaporation of the material.

The center distance H (FIG. 9) between the bearing surfaces 70 and 72 is set such that the nip width B (FIG. 3) by which a sufficient fixing strength is obtainable with no cockle or curling when the toner image is fixed onto the recording sheet 56 by the heating roller 12 and the pressure roller 20 can be obtained. Then, both end portions of the heating roller 12 and both end portions of the pressure roller shaft 26 are supported by the bearing surfaces 70 and 72, respectively.

Then, as similar to the previous embodiments, an optimum nip width is set in accordance with the recording sheet feeding speed (process speed), and therefore, in a case of this embodiment shown, a relationship of the both becomes as shown in the above described table 1. Thereafter, as similar to the above described embodiments, the center distance L is determined in accordance with the nip width on the basis of the above described equation. Then, the center distance H between the bearing surfaces 70 and 72 is set in accordance with the center distance L.

In addition, in this embodiment shown, since the bearings 66 and 68 are uniformly formed with the upper cover 62 and the lower cover 64, in assembling the fixing unit, the heating roller 12 and the pressure roller 20 are supported at the respective fixed positions in a state where the heating roller 12 and the pressure roller 20 are brought into pressure-contact with each other only by joining or coupling the upper cover 62 and the lower cover 64which sandwich the heating roller 12 and the pressure roller 20 to each other. Resultingly, it becomes unnecessary to attach the bearing to the cover with accuracy, and therefore, it is possible to shorten a time for assembling and adjusting the fixing unit, and thus, the image forming apparatus, and it is possible to shorten a working time for maintenance of the image forming apparatus. Furthermore, according to this embodiment shown, it is possible to reduce the number of components.

Figure 10:
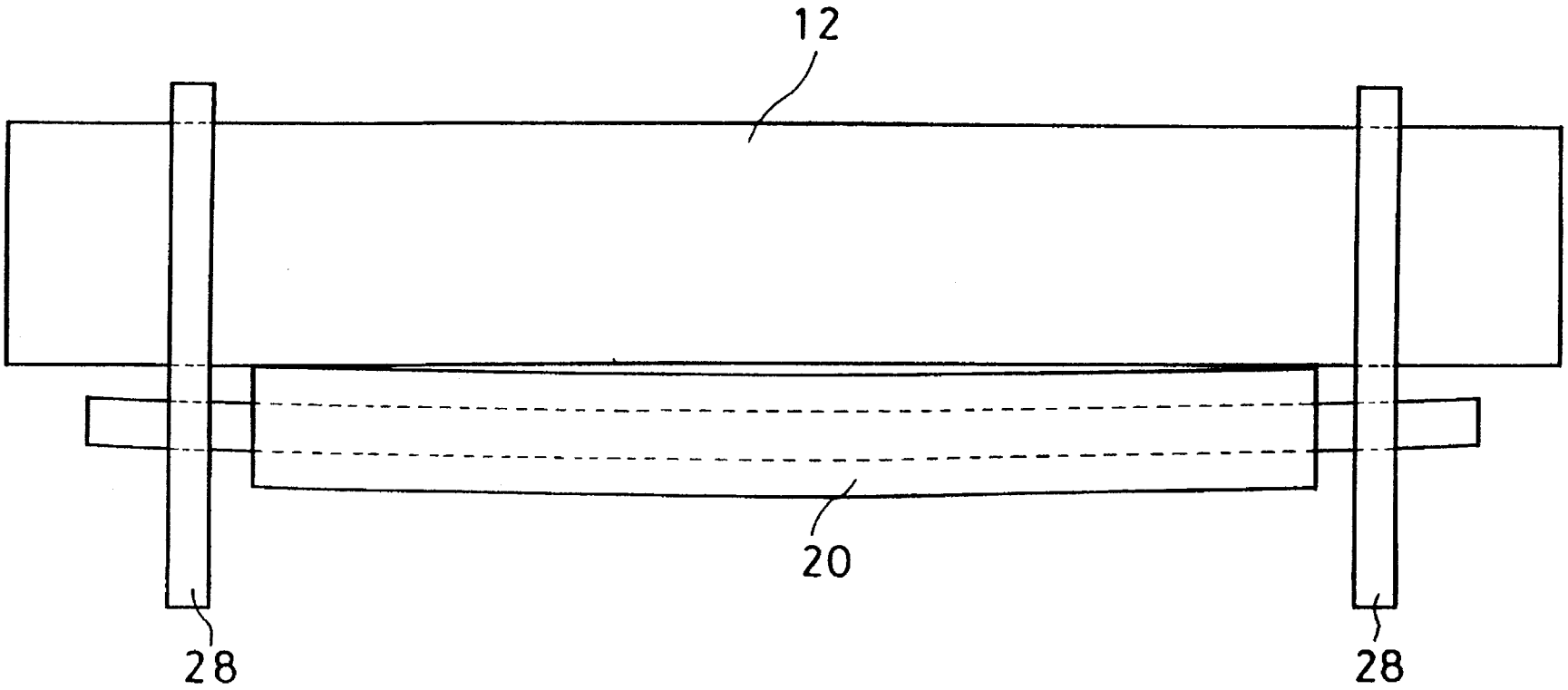
FIG. 10 is an illustrative view showing a state where the pressure roller is deflected.

In addition, in the above described embodiment, the heating roller 12 and the pressure roller 20 are supported at the both end portions so as to be brought into pressure-contact with each other, the heating roller 12 and the pressure roller 20 are deflected as shown in FIG. 10. Resultingly, the pressure-contact force between the heating roller 12 and the pressure roller 20 does not become even in an axial direction, and therefore, the pressure-contact force at a center portion of the axial direction becomes smaller than the pressure-contact force at the end portion of the axial direction. Therefore, not only the fixing strength at the center portion is lowered but also the feeding force for the recording sheet is lowered.

Figure 11:
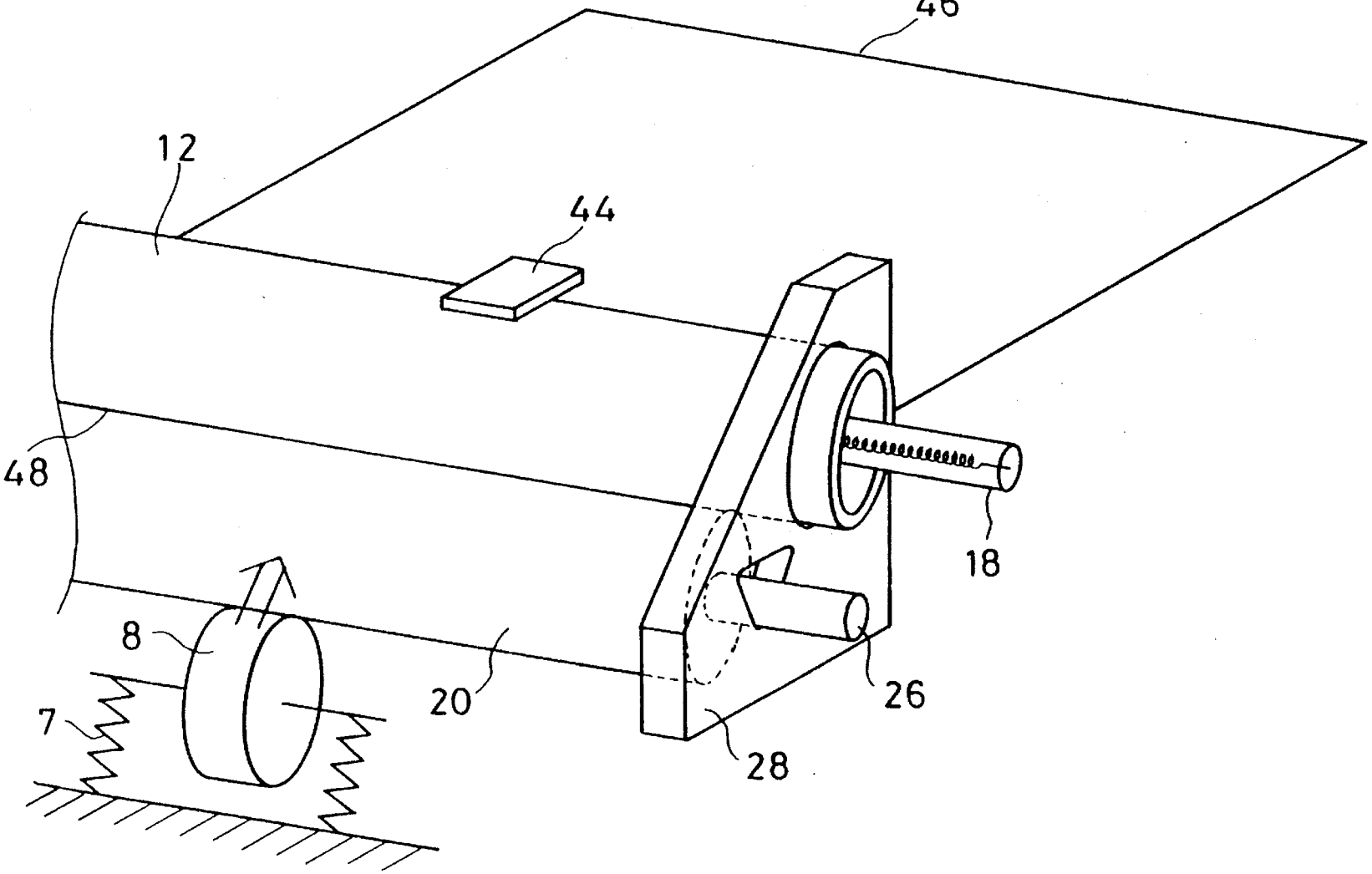
FIG. 11 is a perspective view showing a major portion of another embodiment according to the present invention, which is capable of correcting the deflection of the pressure roller.

Then, in an embodiment shown in FIG. 11, the deflection of the pressure roller 20 can be corrected by pushing an approximately center portion of the pressure roller 20 in the axial direction by a back-up roller 8 which is connected to a spring 7. That is, in FIG. 11 embodiment, by pushing the center portion of the pressure roller 20 by means of the back-up roller 8, the deflection which occurs in the center portion of the pressure roller 20 can be corrected.

Figure 12:
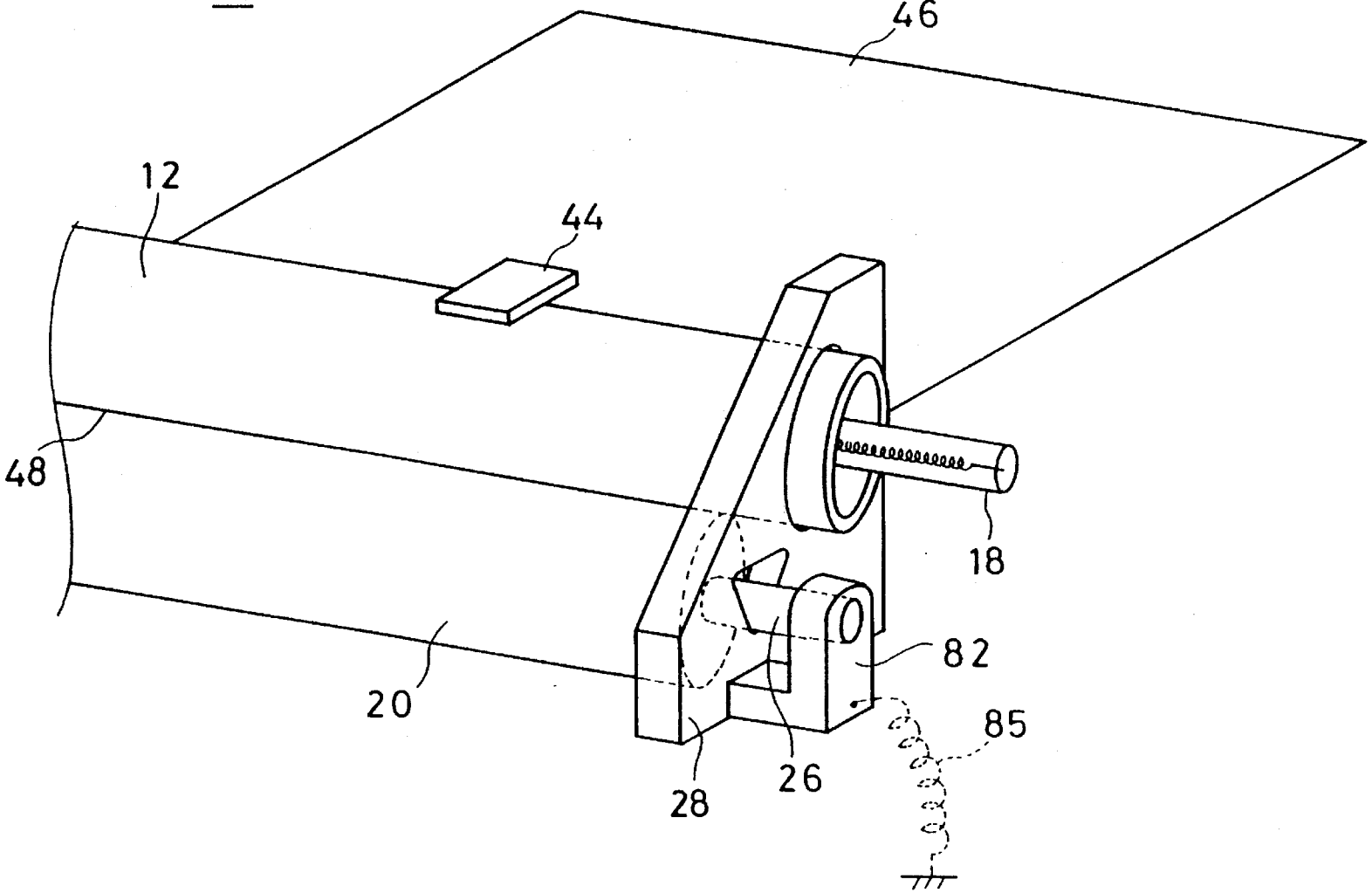
FIG. 12 is a perspective view showing a major portion of another embodiment according to the present invention, which is capable of correcting the deflection of the pressure roller.
Figure 13B:
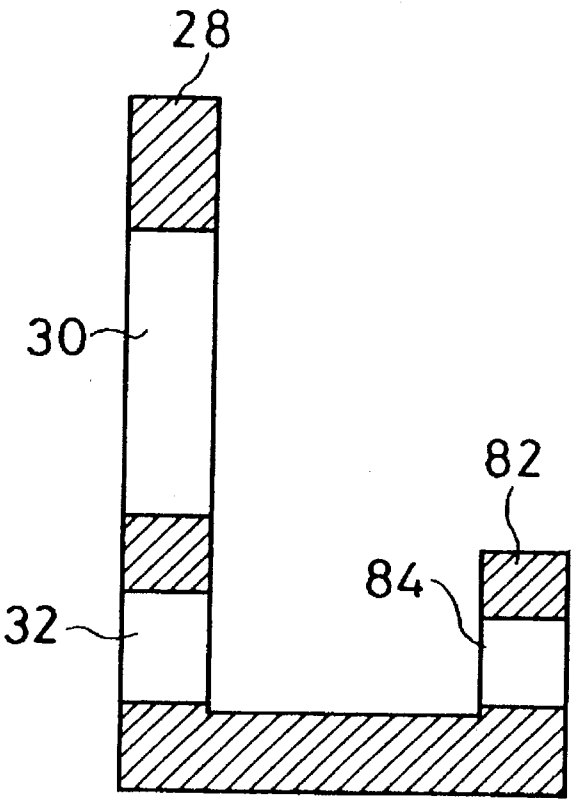
FIG. 13(B) is a cross-sectional view of FIG. 13(A) at a line A—A.
Figure 13A:
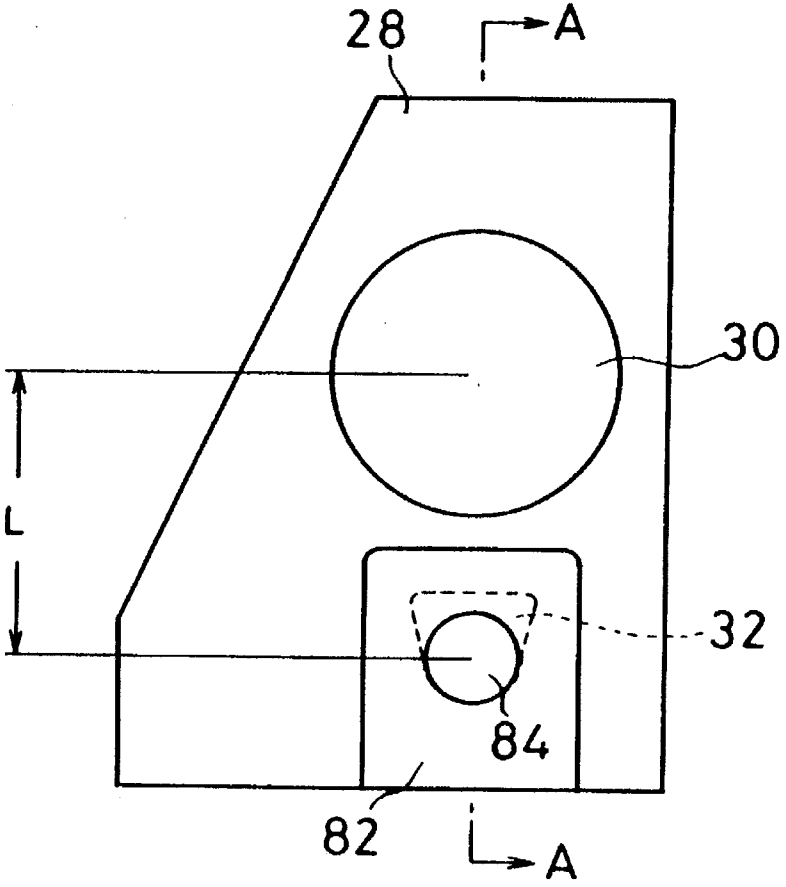
FIG. 13(A) is a front view showing a bearing and a correction member of FIG. 12 embodiment.

FIG. 12 shows a fixing unit 80 according to another embodiment, in which the deflection of the pressure roller 20 can be corrected. The fixing unit 80 of this embodiment shown is constructed in a manner similar to that of FIG. 1 embodiment except a point that an L-letter shape correcting member 82 is uniformly formed with the bearing 28 as shown in FIG. 13.

Figure 14:
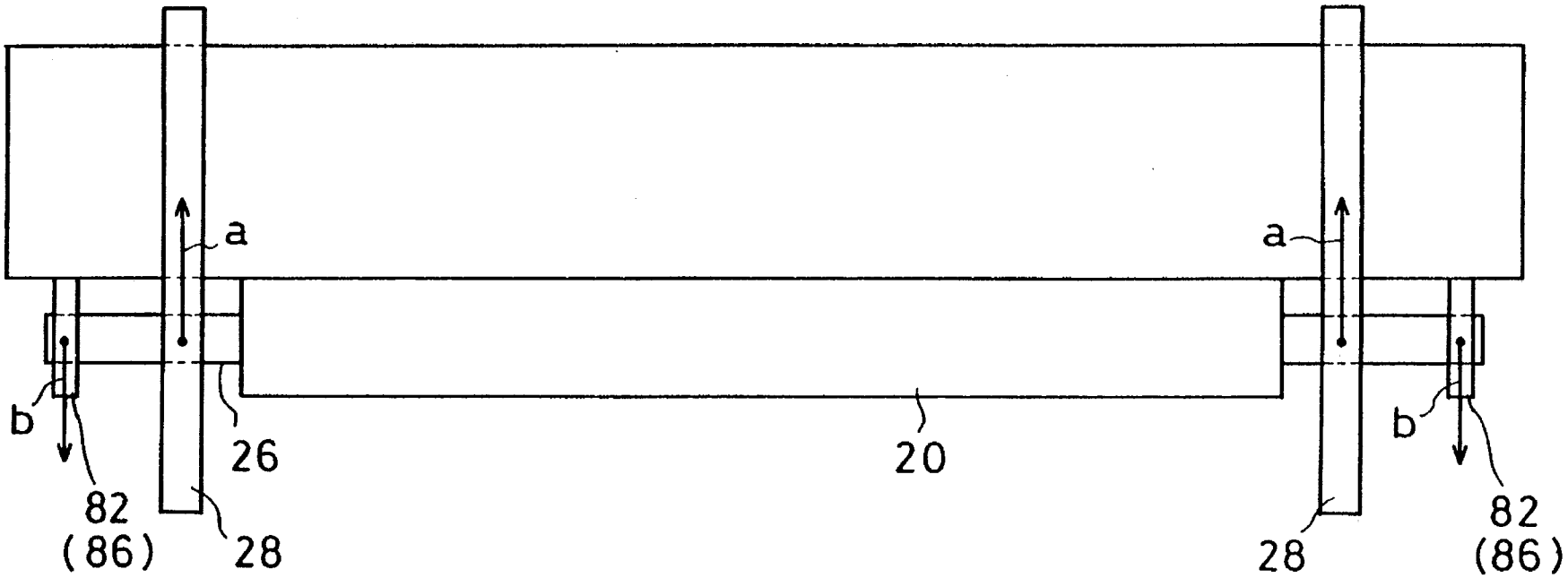
FIG. 14 is an illustrative view showing the correction of the deflection in a case where the correction member of FIG. 13 or a repulsion roller of FIG. 15 is utilized.

In the fixing unit 80, both end portions of the heating roller 12 are supported by the holes 30 formed on the bearing 28, and the both end portions of the pressure roller shaft 26 and portions slightly inside the both end portions are supported by holes 854 formed on the correcting member 82 and the holes 32 formed on the bearing 28. A force is applied to the shaft 26 by the bearing 28 in a direction that the pressure roller 20 is brought into pressure-contact with the heating roller 12 as indicated by an arrow mark "a" in FIG. 14. A force is applied to the shaft 26 by the correcting member 82 in a direction that the pressure roller 20 is separated from the heating roller 12 as indicated by an arrow mark "b" (direction opposite to the arrow mark "a") in FIG. 14. Resultingly, as seen through the comparison of FIG. 10 and FIG. 14, the pressure roller 20 is evenly adhered to the heating roller 12 in the axial direction, and therefore, the pressure-contact force in the axial direction becomes even. Thus, the deflection which occurs in the pressure roller 20 in the structure that the heating roller 12 and the pressure roller 20 are supported by the bearing 28 can be corrected by the correcting member 82.

In this embodiment shown, by supporting the heating roller 12 and the pressure roller 20 by the bearing 28 so as to satisfy the condition of the above described equation, the center distance L between the heating roller 12 and the pressure roller 20 is fixed or kept, and further, the deflection of the pressure roller can be corrected by the correcting member 82. In addition, in comparison with FIG. 11 embodiment, in FIG. 12 embodiment, the number of components is reduced, and therefore, it is possible to reduce a cost.

Figure 16:
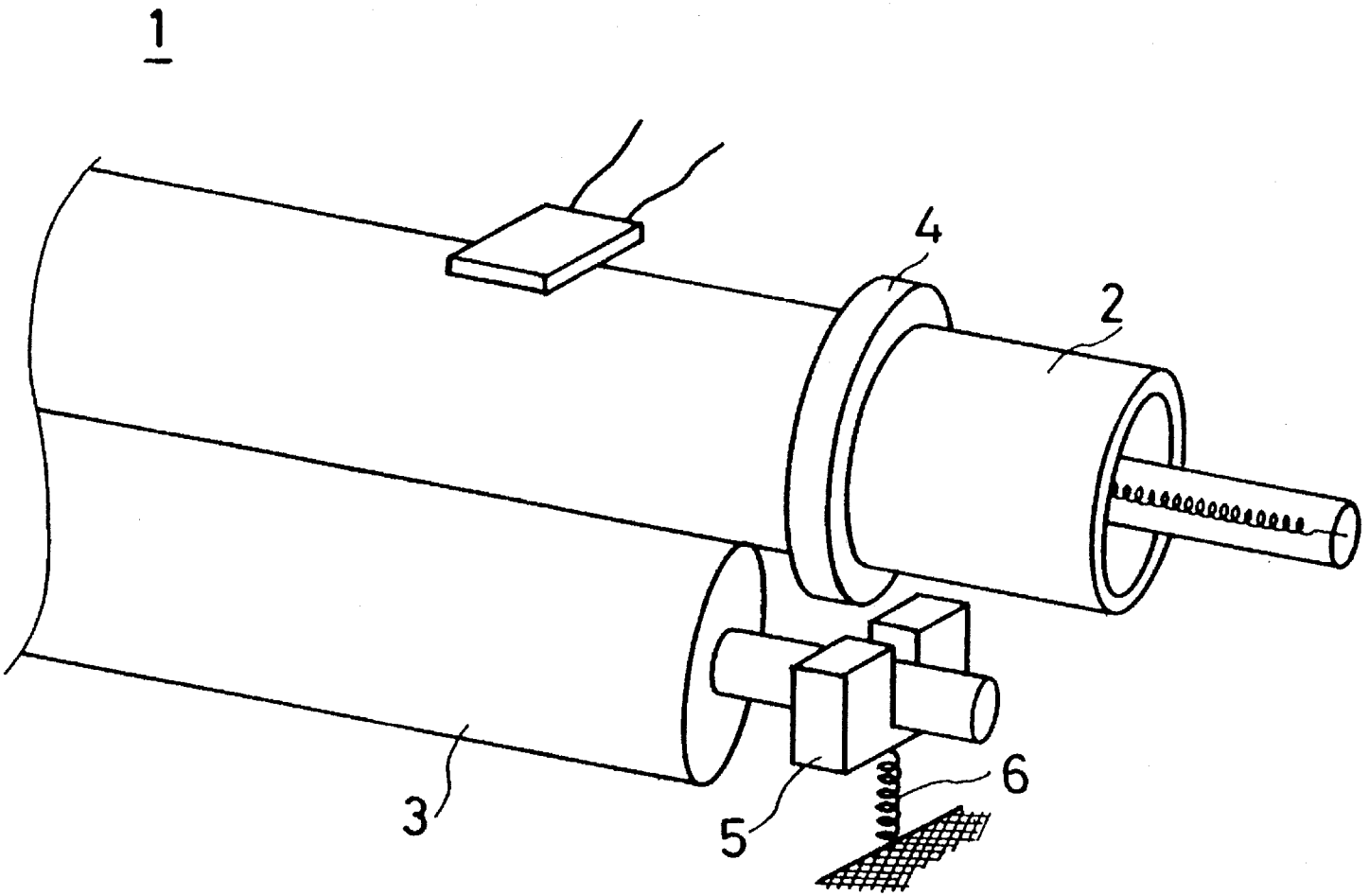
PRIOR ART FIG. 16
FIG. 16 is a perspective view showing a major portion of the prior art.

Furthermore, in this embodiment shown, it is possible to substitute the frame or the like which holds the spring for pressure-contact and the bearing 28 as shown in FIG. 16with the bearing 28 and the correcting member 82 which are made in one-piece fashion, and therefore, it is possible to largely reduce the number of fastening members such as screws. Accordingly, it is possible to largely shorten a time for assembling and adjusting the fixing unit, and thus, the image forming apparatus and a time for maintenance of the image forming apparatus. Furthermore, if the correcting member 82 is pulled by a spring 85, for example, as shown in FIG. 12 in a direction opposite to pressure-contact direction of the pressure roller 20, the deflection of the pressure roller 20 can be more effectively corrected.

In the fixing unit 80 shown in FIG. 12 and FIG. 13, in assuming that a pressure-contact length X of the heating roller 12 and the pressure roller 20 is 225 mm, a material of which the heating roller 12 is made is aluminum, a material of which the pressure roller 20 is made is iron, when the pressure-contact force P between the heating roller 12, pressure roller 20 is changed, a result shown in the following table 2 is obtainable.

$$Y_H = \frac{5PX^3}{6\pi(D_H^4 - d_H^4)E_H}$$

$$Y_P = \frac{5PX^3}{6\pi D_P^4 E_P}$$

TABLE 2

| P | $D_H$ | $d_H$ | $D_P$ | $Y_H$ | $Y_P$ |
|---|---|---|---|---|---|
| 20 | 30 | 24 | 16 | 0.035 | 0.088 |
| 15 | 25 | 19 | 14 | 0.048 | 0.112 |
| 10 | 25 | 21 | 12 | 0.042 | 0.139 |
| 5 | 22 | 18 | 10 | 0.032 | 0.144 |
| 3 | 20 | 16 | 8 | 0.026 | 0.211 |

TABLE 2-continued

| P | $D_H$ | $d_H$ | $D_P$ | $Y_H$ | $Y_P$ |
|---|---|---|---|---|---|
| 2.5 | 16 | 13 | 7 | 0.056 | 0.300 |
| 2 | 14 | 12 | 6 | 0.094 | 0.444 |
| 1.5 | 12 | 10 | 6 | 0.116 | 0.333 |

$D_H$: the outer diameter of the heating roller (mm)
$d_H$: the inner diameter of the heating roller (mm)
$D_P$: the diameter of the pressure roller shaft (mm)
P: the pressure-contact force between the heating roller and the pressure roller (kg/mm)
X: the pressure-contact length of the heating roller and the pressure roller (mm)
$E_H$: the modulus of longitudinal elasticity of the heating roller (aluminum = 7300 kgf/mm$^2$)
$E_P$: the modulus of longitudinal elasticity of the pressure roller (iron = 21000 kgf/mm$^2$)
$Y_H$: the deflection amount at the center portion of the heating roller (mm)
$Y_P$: the deflection amount at the center portion of the pressure roller (mm)

The deflection amount $Y_H$ at the center portion of the heating roller 12 and the deflection amount $Y_P$ at the center of the pressure roller 20 are indicated as deviation amounts from ideal positions of a case where no deflections occur at the center portions thereof.

Through the experience, it is considered that any deflection preventing mechanism is required in a case where the outer diameter $D_H$ of the heating roller 12 is less than 16 mm, the inner diameter $d_H$ of the heating roller 12 is less than 13 mm, and the diameter $D_P$ of the pressure roller shaft 26 is less than 7 mm, that is, in a case of combination of the sizes indicated in the sixth row or below in the above described table 2. The reason is that as the fixing unit is miniaturized, the smaller heating roller 12 and the pressure roller 20, the larger deflection. Therefore, the fixing unit 80 shown in FIG. 12 becomes especially effective in a case where the heating roller 12 and the pressure roller 20 having small diameters are utilized.

Figure 15:
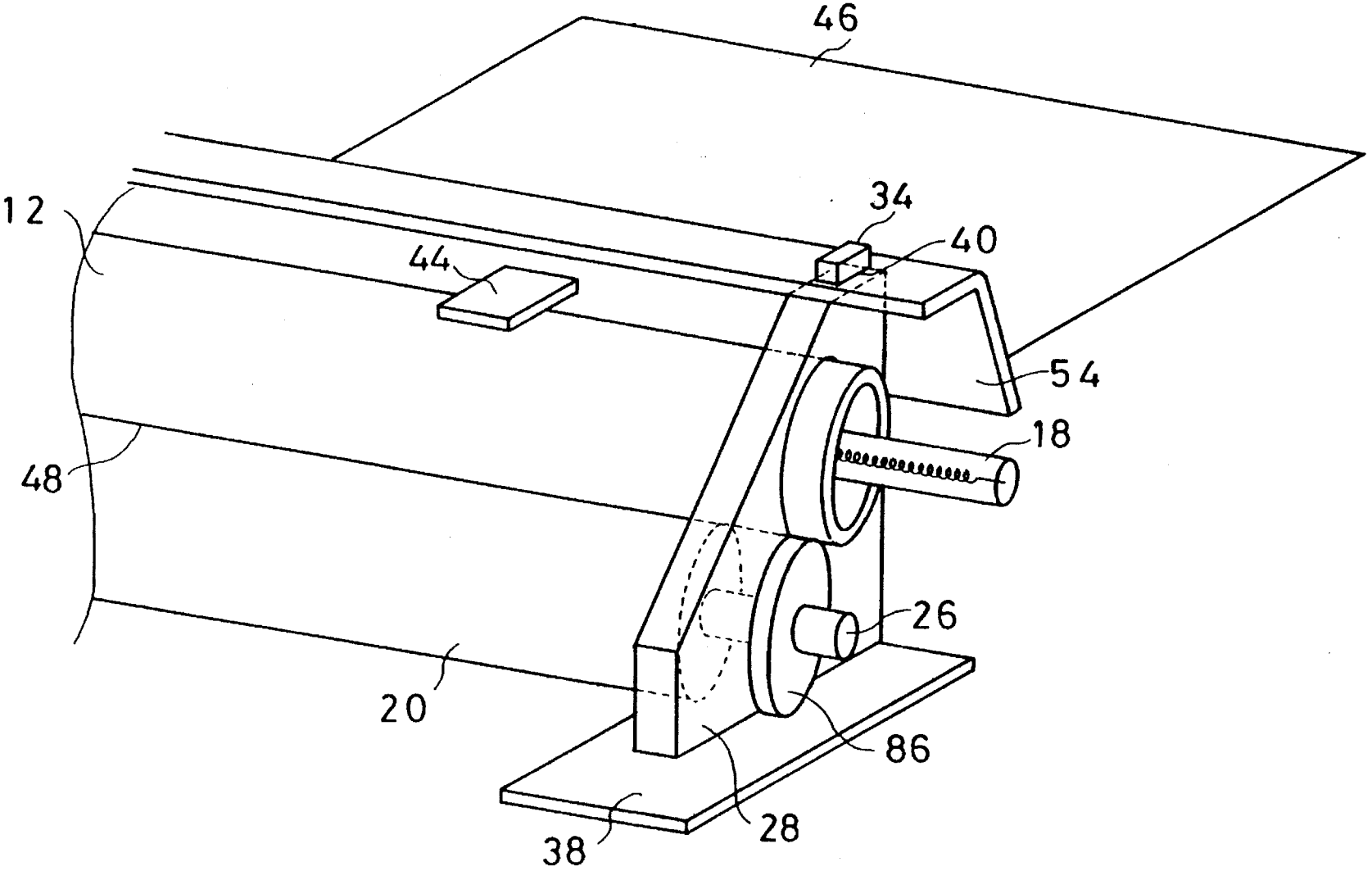
FIG. 15 is a perspective view showing a major portion of another embodiment according to the present invention.

Furthermore, as shown in FIG. 15, as a correcting means, a repulsion roller 86 may be utilized. More specifically, the repulsion roller 86 are attached to each of both ends of the pressure roller shaft 26, and the surface of the repulsion roller 86 is brought into pressure-contact with the heating roller 12. Accordingly, a force is applied to the shaft 26 in a direction that the pressure roller 20 is separated from the heating roller 12 as indicated by the arrow mark "b" in FIG. 14, and therefore, the deflection of the pressure roller 20 can be corrected. In addition, at this time, a force is applied by the bearing 28 to the shaft 26 in a direction that the pressure roller 20 is brought into pressure-contact with the heating roller 12 as indicated by the arrow mark "a" in FIG. 14. In this embodiment shown, by utilizing the repulsion rollers 86, it is possible to obtain an advantage similar to that of FIG. 12 embodiment.

Furthermore, in the above described embodiments shown in FIG. 12 and FIG. 15, a case where the deflection of the pressure roller 20 is corrected is described; however, the deflection of the heating roller may be corrected, and the deflections of the both of the heating roller 12 and the pressure roller 20 may be corrected.

Furthermore, in the above described embodiments, the elastic member layer 24 is formed on the surface of the pressure roller 20; however, such an elastic member layer may be also formed on the surface of the heating roller 12, and the elastic member layer may be formed on the surface of only the heating roller 12.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A fixing unit, comprising:

a pair of a heating roller and a pressure roller having an elastic member formed on a surface of at least one of said heating roller and the pressure roller, said heating roller and said pressure roller being brought into pressure-contact with each other in a state that said elastic member is elastically deformed; and supporting means for rotatably supporting said heating roller and pressure roller at respective fixed positions such that a center distance L between said heating roller and pressure roller satisfies the following equation:

$$L=D½+D2/2-B^2/4\ (1/D1+1/D2)$$

where D1 is a diameter of said heating roller, D2 is a diameter of said pressure roller, and B is a nip width between said heating roller and said pressure roller.

2. A fixing unit according to claim 1, wherein said supporting means includes at least one bearing means on a first supporting portion for said heating roller and a second supporting portion for said pressure roller.

3. A fixing unit according to claim 2, wherein said bearing means includes a bearing plate on which both of said first supporting portion and said second supporting portion are formed.

4. A fixing unit according to claim 2, wherein said bearing means includes a first bearing plate on which said first supporting portion is formed, and a second bearing plate on which said second supporting portion is formed.

5. A fixing unit according to claim 4, further comprising:

a first cover for covering said heating roller; and a second cover for covering said pressure roller, wherein said first bearing plate and said second bearing plate are uniformly formed with said first cover and said second cover, respectively.

6. A fixing unit according to claim 5, wherein said first cover and said first bearing plate are uniformly molded with resin having at least heat resistance, and said second cover and said second bearing plate are uniformly molded with resin having at least heat resistance.

7. A fixing unit according to claim 5, wherein said first cover and said first bearing plate are uniformly molded with resin having heat resistance and slidability, and said second cover and said second bearing plate are uniformly molded with resin having heat resistance and slidability.

8. A fixing unit according to claim 2, wherein said first supporting portion of said bearing means supports both ends of said heating roller, and said second portion supports both ends of a shaft of said pressure roller, further comprising:

correcting means for correcting a deflection which occurs in at least one of said heating roller and said pressure roller.

9. A fixing unit according to claim 8, wherein said deflection occurs due to a fact that a pressure-contact force between the said heating roller and said pressure roller at end portion thereof is larger than a pressure-contact force at a center portion thereof, and said correcting means includes means for making said pressure-contact even in an axial direction.

10. A fixing unit according to claim 9, wherein said means includes means for pushing the center portion in an axial direction of at least one of said heating roller and said pressure roller toward the other roller.

11. A fixing unit according to claim 9, wherein said means includes further supporting means for supporting said shaft of said pressure roller at a portion outside said second supporting portion, and the center portion of said shaft is biased toward said heating roller by said further supporting means with a fulcrum of said second supporting portion.

12. An image forming apparatus which comprises a fixing unit for fixing a toner image onto a recording sheet, said fixing unit including:

a pair of a heating roller and a pressure roller having an elastic member formed on a surface of at least one of said heating roller and the pressure roller, said heating roller and said pressure roller being brought into pressure-contact with each other in a state that said elastic member is elastically deformed; and supporting means for rotatably supporting said heating roller and pressure roller at respective fixed positions such that a center distance L between said heating roller and pressure roller satisfies the following equation:

$$L=\frac{1}{2}+D2/2-B^2/4\ (1/D1+1/D2)$$

where D1 is a diameter of said heating roller, D2 is a diameter of said pressure roller, and B is a nip width between said heating roller and said pressure roller.

* * * * *